US008746597B2

(12) United States Patent
Sides

(10) Patent No.: US 8,746,597 B2
(45) Date of Patent: Jun. 10, 2014

(54) ELECTROSTATIC SPRAY SYSTEM

(75) Inventor: Michael L. Sides, Goldthwaite, TX (US)

(73) Assignee: E-Mist Innovations, Inc., Fort Worth, TX (US)

( * ) Notice: Subject to any disclaimer, the term of this patent is extended or adjusted under 35 U.S.C. 154(b) by 340 days.

(21) Appl. No.: 12/882,671

(22) Filed: Sep. 15, 2010

(65) Prior Publication Data

US 2011/0068187 A1 Mar. 24, 2011

Related U.S. Application Data

(60) Provisional application No. 61/244,308, filed on Sep. 21, 2009.

(51) Int. Cl.
*B05B 5/00* (2006.01)

(52) U.S. Cl.
USPC ..... 239/706; 239/705

(58) Field of Classification Search
CPC ..... B05B 5/00; B05B 5/0426
USPC ..... 239/690, 690.1, 692, 705, 706, 708, 239/290, 291
See application file for complete search history.

(56) References Cited

U.S. PATENT DOCUMENTS

| | | | | |
|---|---|---|---|---|
| 4,273,293 | A * | 6/1981 | Hastings | 239/705 |
| 5,584,931 | A | 12/1996 | Buhlmann | |
| 5,765,761 | A | 6/1998 | Law et al. | |
| 7,240,861 | B2 * | 7/2007 | Zhu et al. | 239/690 |
| 7,913,938 | B2 * | 3/2011 | Cooper | 239/690 |
| 2007/0194157 | A1 * | 8/2007 | Golden et al. | 239/698 |
| 2008/0229606 | A1 | 9/2008 | Hirai | |
| 2009/0078800 | A1 | 3/2009 | Nakasone et al. | |

FOREIGN PATENT DOCUMENTS

| | | |
|---|---|---|
| DE | 19954914 | 5/2001 |
| EP | 0645192 | 3/1995 |
| GB | 1283880 | 8/1972 |

* cited by examiner

*Primary Examiner* — Davis Hwu
(74) *Attorney, Agent, or Firm* — Gardere Wynne Sewell LLP

(57) ABSTRACT

An electrostatic spray system, comprising a hand held device having an inlet and an outlet. The hand held device includes a charging device for producing a high voltage charging field and a spray nozzle having an outlet, the outlet being disposed within the charging field. The system further includes an air movement system disposed within the hand held device, the air movement system configured to produce an airflow around the spray nozzle and through the high voltage charging field to create a directionally controllable electrostatic charged mist existing the hand held device at low velocities.

21 Claims, 4 Drawing Sheets

ELECTROSTATIC SPRAY SYSTEM

CLAIM OF PRIORITY

This application claims the benefit of U.S. Provisional Application No. 61/244,308, filed Sep. 21, 2009, the disclosure of which is incorporated herein by reference in its entirety.

BACKGROUND

Electrostatic sprayers are used to provide an electrical potential difference between charged fluid particles and a target device. However, existing systems require numerous components, contain complicated designs, and further, the velocity of the charged particles exiting these electrostatic sprayers is increased, thereby reducing the efficiency of such devices. This results in an overspray and/or charged particles passing the intended target ultimately requiring more fluid to spray the intended target.

SUMMARY

Embodiments provided herein comprise an electrostatic spray system having a hand held device in which an airflow system generates an airflow from within the hand held device. In particular, a fan disposed within the hand held device directs a forced air flow over a nozzle and charging device to create a directionally controllable electrostatic charged mist exiting the hand held device at relatively low velocities. Power for generating an electrostatic field, operating the fan, and facilitating fluid flow for the electrostatic spray system is provided by a remote source, which contains a spray mixture tank, a liquid pump, and an electrical source to support the functions of the hand held device. The hand held device and remote source are detachably connected together via a hose and electric wires.

In operation, air generated within the hand held device is forced over and/or otherwise around the nozzle (but not through the nozzle tip) so that the mist exiting the nozzle is mixed with the forced airflow and electrically charged via the high voltage charging device. The forced airflow over the nozzle and use of the high voltage charging device generate the directable charged mist cloud for depositing the spray mixture onto a target thereby resulting in electrostatic deposition on the chosen target.

DETAILED DESCRIPTION

Figure 1:
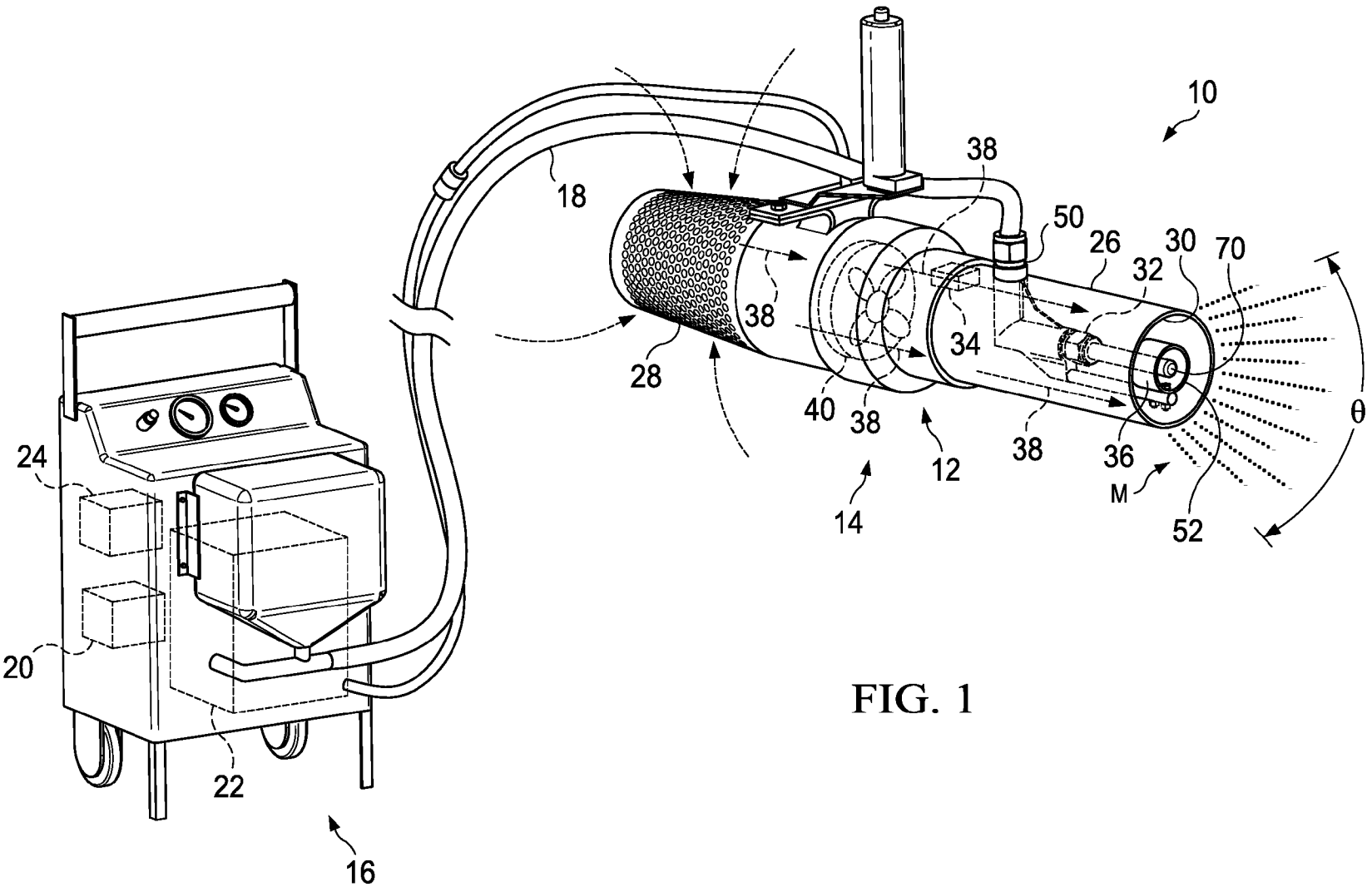
FIG. 1 is an illustration of an electrostatic spray system in which a low velocity directionally controllable electrostatic charged mist is output therefrom.

In the description which follows, like parts are marked throughout the specification and drawings with the same reference numerals, respectively. The drawings are not necessarily to scale and certain features may be shown exaggerated in scale or in somewhat schematic form in the interest of clarity and conciseness.

FIG. 1 is an illustration of an electrostatic spray system 10 in which an internal air movement system 12 is employed to advantage to output a low velocity and directionally controllable electrostatic charged mist M. Electrostatic spray system 10 comprises a hand held device 14 detachably coupled to a remote base or cart 16 via a retractable hose 18. Cart 16 comprises a pump 20, a fluid supply tank 22, a power source 24 and necessary control elements (i.e., microcontroller, relays, etc.) for operation of system 10, and in particular, operation of hand held device 14.

Figure 2:
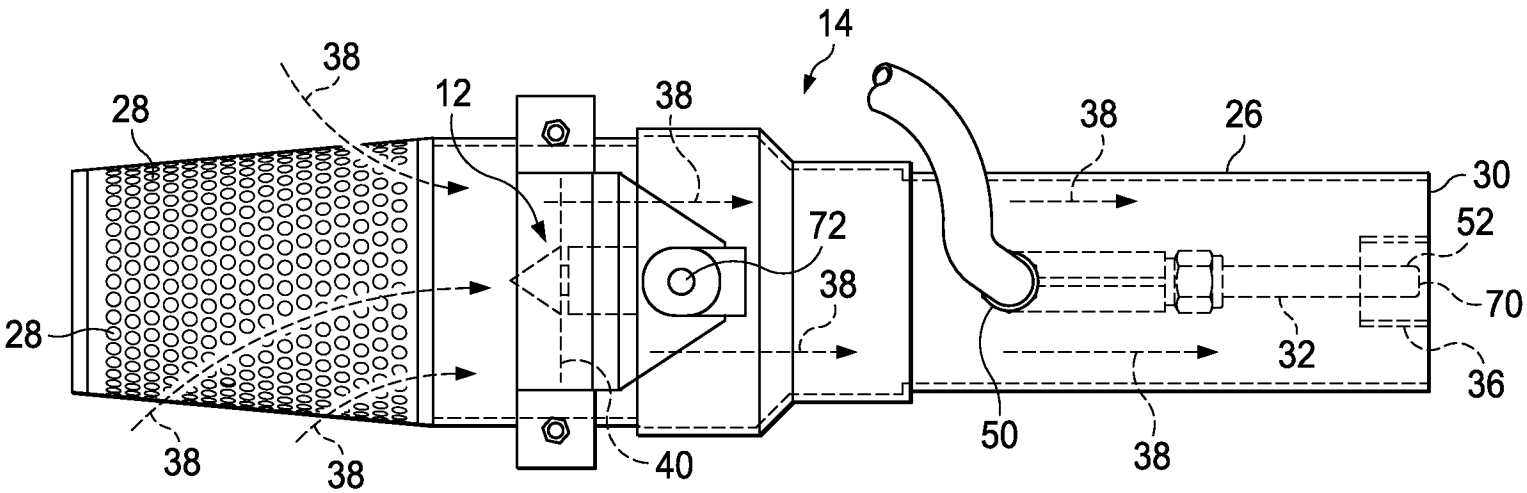
FIG. 2 is a top view of a portion of the electrostatic spray system of FIG. 1.

Referring to FIGS. 1 and 2, hand held device 14 generally comprises a tubular member or chamber 26 having an air inlet 28 and an air outlet 30. Chamber 26 is sized to house and/or otherwise support a spray nozzle 32, a high voltage power supply or charging element 34 (FIG. 1) electrically coupled to a remote power source 24, a charging device 36 disposed generally adjacent to outlet 30 and nozzle 32 for creating a high voltage charging field, and air movement system 12. In operation, air movement system 12 draws air within inlet 28 and forces airflow along the airflow path designated by arrows 38 over and/or otherwise around nozzle 32 and charging device 36, the forced airflow and charging device 36 facilitating the delivery of electrostatic charged mist M through outlet 30 at relatively low velocities.

Referring specifically to FIG. 2, air movement device 12 comprises an axial fan 40 to generate airflow through chamber 26 and over nozzle 32. Preferably, axial fan 40 is sized to provide an airflow rate between 3,000 cubic feet per minute to 5,200 cubic feet per minute; however, it should be understood that fan 40 may be otherwise sized to provide a higher or lower airflow rate. Furthermore, it should be understood that air movement device 12 may be otherwise configured, such as, for example, by utilizing a remotely positioned fan coupled to inlet 28 via a hose (not illustrated) or other types of air movement generating devices. In addition, while FIG. 2 illustrates a single air movement device 12, it should be understood that additional air movement devices 12 can be utilized to provide the desired airflow through chamber 26.

In the embodiment illustrated in FIG. 2, nozzle 32 comprises a fluid inlet 50 coupleable to fluid supply tank 22 via hose 18 (FIG. 1) and a fluid outlet 52 for discharging fluid therefrom. According to some embodiments, nozzle 32 comprises an outlet 52 formed of a ceramic tip 70, such as, for example, the TX3 model manufactured by Spray Systems; however, it should be understood that nozzle outlet 52 may be otherwise formed. For example, nozzle outlet 52 can be constructed using a tip 70 of any type of non-conductive material such as, but not limited to, plastic.

Figure 3:
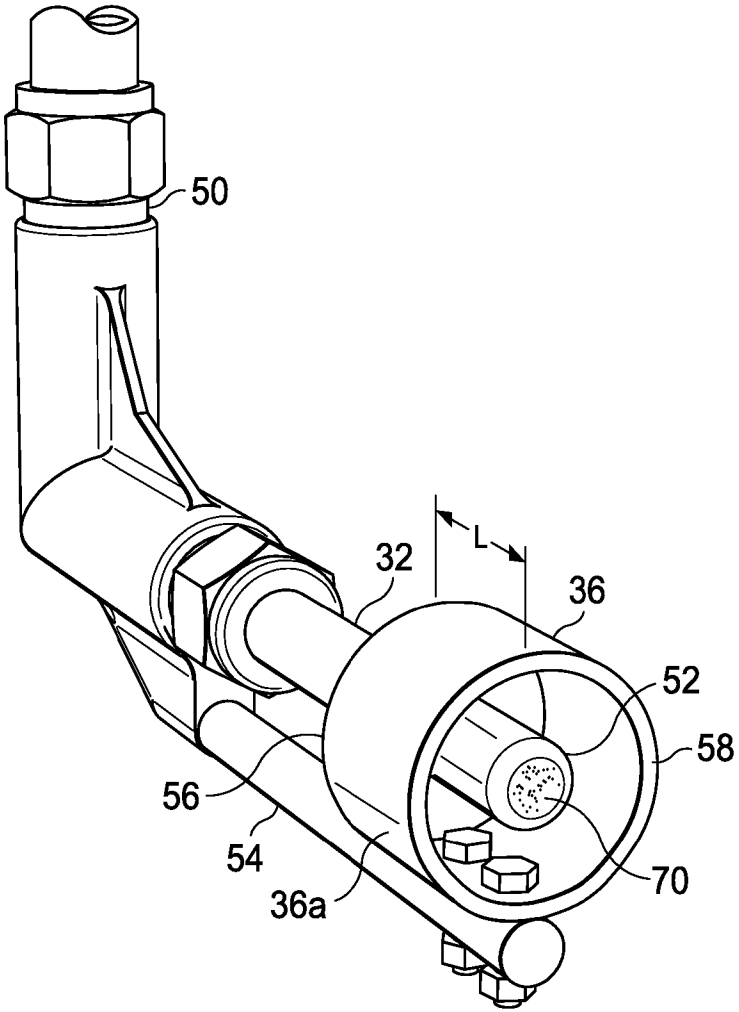
FIG. 3 is an illustration of a charging device disposed adjacent a nozzle outlet of the electrostatic spray system of FIGS. 1 and 2.

FIG. 3 is an illustration of charging device 36 disposed adjacent nozzle 32 of the electrostatic spray system 10 of FIGS. 1 and 2. In the embodiment illustrated in FIG. 3, charging device 36 comprises a generally circular charging ring **36*a* disposed around nozzle 32. According to some embodiments disclosed herein, charging ring 36*a* is coupled to a charging device support member 54 such that nozzle outlet 52 is concentrically disposed within charging ring 36*a*. According to some embodiments, charging ring 36*a* comprises a diameter of approximately 1.25 inches and a length "L" of approximately 1 inch and is formed of 316 stainless steel. Furthermore, as illustrated in FIG. 3, charging ring 36*a* encircles and/or is otherwise disposed around nozzle outlet 52; however, it should be understood that charging ring 36*a* may only partially encircle nozzle outlet 52. In addition, it should be understood that charging ring 36*a* may be otherwise sized (i.e., a larger or smaller diameter and/or length L) and be formed of any type of conductive material. It should be understood that charging ring 36***a* may be otherwise mounted. For example, charging ring 36 may be embedded in or otherwise attached to a sidewall of chamber 26 of handheld device 14.

In the embodiment illustrated in FIG. 3, charging ring 36*a* is mounted on nozzle 32 such that end 56 of charging ring 36*a* is located approximately 0.25 inches behind or offset from nozzle outlet 52 and end 58 of charging ring 36*a* extends in the opposite direction or forward of the nozzle outlet 52; accordingly, as fluid particles flow through nozzle outlet 52, the fluid particles flow through a high voltage charging field created by charging device 36 to form a directionally controllable electrostatic charged mist, as described in more detail below.

Figure 4:
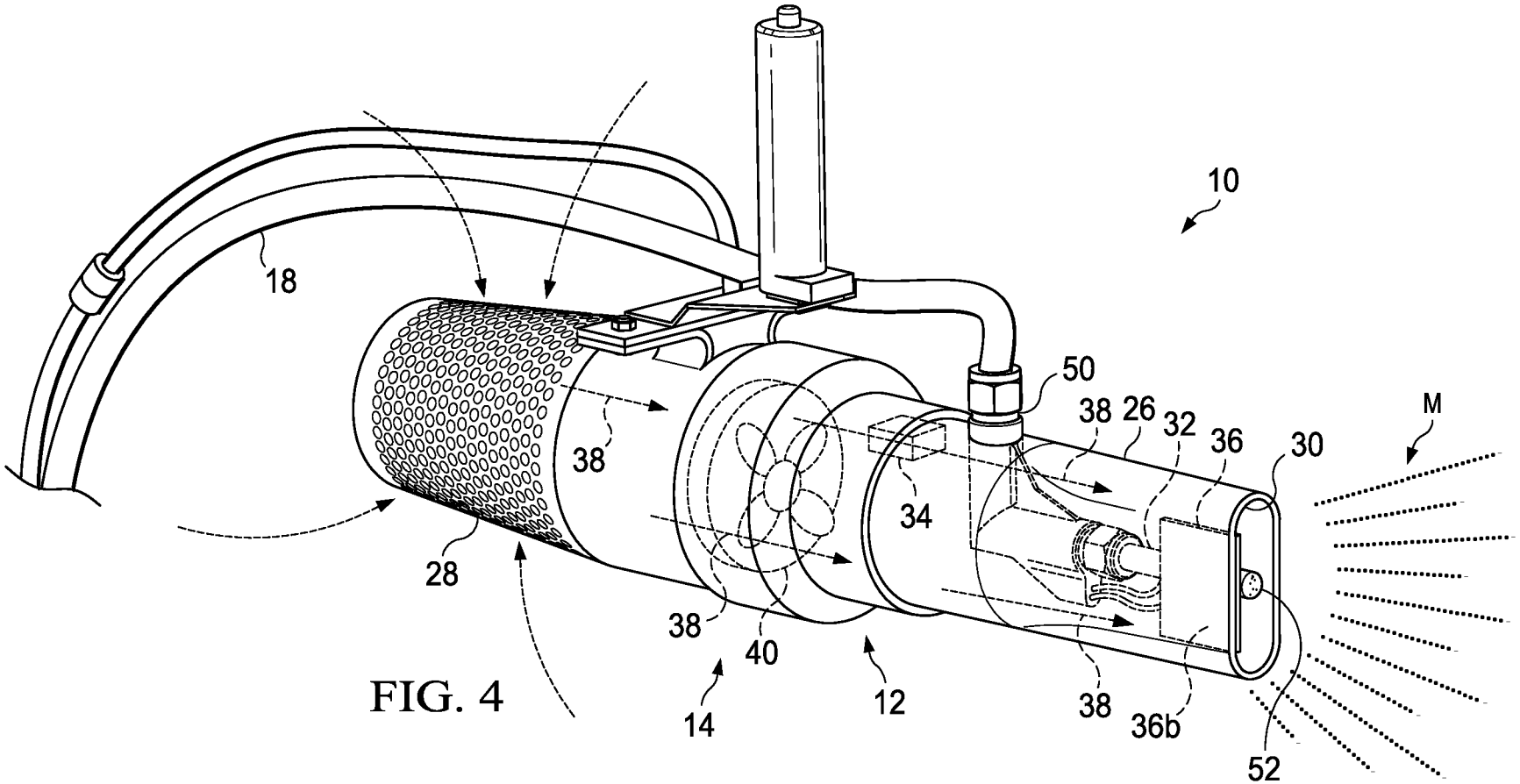
FIG. 4 is an illustration of an alternate configuration of the charging device.

FIG. 4 is an illustration of an alternate configuration of charging device 36 of FIG. 3. In the embodiment illustrated in FIG. 4, charging device 36 comprises a metallic plate 36*b* disposed on the sidewall of chamber 26 generally adjacent to and/or otherwise aligned with nozzle outlet 52 to form a high voltage charging field. As plate 36*b* is charged, fluid particles flowing through nozzle outlet 52 are electrically charged to form the directionally controllable electrostatic charged mist. It should be understood that a greater number of charging plates 36*b* can be used. For example, parallel charging plates 36*b* can be mounted within handheld device 14 on opposite sides of nozzle outlet 52. In the embodiment illustrated in FIG. 4, outlet 30 of chamber 36 is generally oval or racetrack shaped and is configured to produce a generally flat and diverging output of electrostatically charged mist.

Charging device 36 is electrically coupled to high voltage power supply/charging element 34 (FIG. 1) to form the electrically charged mist as it exits outlet 30. In the embodiment illustrated herein, high voltage power supply 34 is mounted on hand held device 14 and converts a DC voltage input (e.g., 12V, 16V, 36V, etc.) to a voltage output level preferably between 3800 and 5200 volts DC to facilitate the of the creation of a high voltage charging field and ultimately, the electrostatic charged mist M; however, it should be understood that power supply 34 may be otherwise located, such as, for example, on cart 16 and convert the DC voltage input to any other desired output level.

In operation, nozzle tip 70 in combination with charging device 36 and air movement system 14 produce desired fluid output patterns at predetermined flow rates. For example, according to some embodiments, tip 70 along with charging device 36 and air movement system 14 facilitate the output of a hollow cone discharge area at an angle θ of approximately 80 degrees, as illustrated specifically in FIG. 1. In some embodiments, the hollow cone end may extend three to four feet in diameter at a position 4-5 inches from the end of hand held device 14. Preferably, electrostatic spray system 10, and in particular, output nozzle 52, is operated under a pressure of approximately 70 pounds per square inch to provide the large and low velocity spraying area at outlet 30 of hand held device 14.

System 10 is operable when a user presses a switch or button 72 on hand held device 14. For example, as switch 72 is pressed, pump 20 and air movement system 12 begin to operate. Fluid is pumped from tank 22 via hose 18 to hand held device 14, and in particular, nozzle 32. As fluid is pumped to nozzle 32, air movement system 12 forces the flow of ambient air through chamber 26 (via air inlet 28), over nozzle outlet 52 and through charging device 36 (and thus a high voltage charging field). Accordingly, as hand held device 14 is pointed at its intended target, a controlled cloud or mist M of charged fluid droplets exits hand held device 14 directly onto the target. The predetermined airflow generated by internal air movement system 12 over nozzle 32 and charging device 36 creates a low velocity electrostatically charged mist exiting hand held device 14 for depositing on a desired target with minimal overspray or maximal coverage thereon.

Although embodiments of the electrostatic spray system 10 have been described in detail, those skilled in the art will also recognize that various substitutions and modifications may be made without departing from the scope and spirit of the appended claims.

What is claimed is:

1. An electrostatic spray system, comprising:

a hand held device having an inlet and an outlet;

a ring-shaped charging device disposed within the hand held device for producing a high voltage charging field;

a spray nozzle having an outlet, the outlet being disposed within the charging field; and an air movement system disposed within the hand held device, the air movement system configured to produce an airflow around and through the ring-shaped charging device, wherein at least a portion of the airflow contacts an interior surface of the ring-shaped charging device and at least another portion of the airflow contacts an exterior surface of the ring-shaped charging device, wherein the ring-shaped charging device and the spray nozzle are suspended in the airflow by an arm that extends into the airflow, wherein at least a portion of the airflow flows between the ring-shaped charging device and an exterior surface of the nozzle to create an electrostatic charged mist exiting the hand held device at low velocities.

2. The system of claim 1, the charging device comprises a metallic circular ring.

3. The system of claim 1, the charging device comprises a metallic ellipse.

4. The system of claim 1, wherein the air movement system comprises an axial fan disposed within the handheld device.

5. The system of claim 4, wherein the air movement system generates an airflow within the hand held device between about 3,000 cubic feet per minute to 5,200 cubic feet per minute.

6. The system of claim 1, wherein the spray nozzle comprises a tip formed of a non-conductive material.

7. The system of claim 1, wherein the charging device is concentrically disposed around the spray nozzle outlet.

8. The system of claim 1, further comprising a charging element electrically coupled to the charging device, wherein the charging element converts a DC voltage to a level between 3800 and 5000 volts DC to create the directionally controllable electrostatic charged mist.

9. The spray system of claim 1, wherein the nozzle outlet produces a conical output of electrostatic particles of approximately 80 degrees.

10. A method of using electrostatic spray system, comprising:

aiming an outlet of a hand held device at an intended target;

causing fluid to be pumped to a nozzle disposed within the hand held device;

causing a ring-shaped charging device, disposed within the hand held device and adjacent to an outlet of the nozzle, to produce a high voltage charging field; and causing an air movement system to generate an airflow within the hand held device around and through the ring-shaped charging device, wherein at least a portion of the airflow contacts an interior surface of the ring-shaped charging device and at least another portion of the airflow contacts an exterior surface of the ring-shaped charging device, wherein the ring-shaped charging device and the spray nozzle are suspended in the airflow by an arm extending into the airflow, wherein at least a portion of the airflow flows between the ring-shaped charging device and an exterior surface of the nozzle to create an electrostatic charged mist existing the hand held device at low velocities to spray the intended target.

11. The method of claim 10, further comprising causing the air movement system to generate an airflow through a circular charging device.

12. The method of claim 10 further comprising causing the air movement system to generate an airflow through an elliptical charging device.

13. The method of claim 10, further comprising causing the air movement system, nozzle and charging device to generate an electrostatically charged mist exiting the nozzle outlet having a conical shape.

14. An electrostatic spray system, comprising:

a hand held device having an inlet and an outlet;

a nozzle coupled to a fluid supply, the nozzle disposed within the hand held device and having an outlet;

a ring-shaped charging device disposed within the hand held device and at least partially around the nozzle outlet for producing a charging field; and an air movement system configured to generate an airflow within the hand held device around and through the ring-shaped charging device, wherein at least a portion of the airflow contacts an interior surface of the ring-shaped charging device and at least another portion of the airflow contacts an exterior surface of the ring-shaped charging device, wherein the nozzle and the ring-shaped charging device are suspended in the airflow by an arm extending into the airflow, wherein at least a portion of the airflow flows between the ring-shaped charging device and an exterior surface of the nozzle to create an electrostatic charged mist existing the hand held device at low velocities.

15. The system of claim 14, wherein the charging device comprises a circular ring.

16. The system of claim 14, wherein the charging device comprises a metallic ellipse aligned with the nozzle outlet.

17. The system of claim 14, wherein the fluid supply is remotely stored from the hand held device.

18. The system of claim 14, wherein the nozzle and charging device produce an electrostatically charged mist exiting the nozzle outlet having a conical shape.

19. The system of claim 14, wherein the air movement system is disposed within the hand held device.

20. The system of claim 19, wherein the air movement system comprises an axial fan.

21. The electrostatic spray system of claim 1, wherein at least a portion of the arm extends transverse to the airflow.

* * * * *